US008525860B2

(12) United States Patent
Ishii et al.

(10) Patent No.: US 8,525,860 B2
(45) Date of Patent: Sep. 3, 2013

(54) PRINTER

(75) Inventors: Hiroyasu Ishii, Shizuoka (JP); Kiyoshi Morino, Shizuoka (JP); Sadayoshi Mochida, Shizuoka (JP); Chikahiro Saegusa, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 77 days.

(21) Appl. No.: 13/337,439

(22) Filed: Dec. 27, 2011

(65) Prior Publication Data

US 2012/0162342 A1 Jun. 28, 2012

(30) Foreign Application Priority Data

Dec. 28, 2010 (JP) ..... 2010-293606

(51) Int. Cl.
*B41J 32/00* (2006.01)

(52) U.S. Cl.
USPC ..... 347/214

(58) Field of Classification Search
USPC ..... 347/214, 212, 102, 101
See application file for complete search history.

(56) References Cited

U.S. PATENT DOCUMENTS 5,505,550 A 4/1996 Kitahara et al.

FOREIGN PATENT DOCUMENTS

JP 07-256965 10/1995

*Primary Examiner* — Kristal Feggins
(74) *Attorney, Agent, or Firm* — Turocy & Watson, LLP

(57) ABSTRACT

A printer comprises a conveying unit configured to convey a medium. The printer includes an image forming unit provided in a conveyance path of the medium, the image forming unit being configured to form an image with a temperature-sensitive ink, whose color is changed depending on a temperature, on the medium. A cutter for cutting the medium is provided in the conveyance path downstream of a medium conveyance direction of the image forming unit. Further, a coloring conversion unit is provided in the conveyance path downstream of a medium conveyance direction of the cutter. The coloring conversion unit is configured to change a coloring state of the image of the temperature-sensitive ink by heating or cooling the image of the temperature-sensitive ink formed on the cut medium.

13 Claims, 15 Drawing Sheets

PRINTER

CROSS-REFERENCE TO RELATED APPLICATION

This application is based upon and claims the benefit of priority from Japanese Patent Application No. 2010-293606, filed on Dec. 28, 2010, the entire contents of which are incorporated herein by reference.

FIELD

Embodiments described herein relate generally to a printer.

BACKGROUND

Conventionally, printers having a plurality of print heads as an image forming unit for forming an image on a medium are known. In this type of printer, a plurality of image forming units are used in forming ink images on a medium. Further, for forming the ink images, the printer may use a temperature-sensitive ink that changes its color according to the ambient temperature.

In the printer above, when forming an image with a temperature-sensitive ink on a medium, it is desirable to prevent any problems caused by the color change of the temperature-sensitive ink. Unfortunately, the conventional printer does not provide any suitable mechanism to control the color change of the temperature-sensitive ink.

DETAILED DESCRIPTION

According to one embodiment of the present disclosure, a printer includes a conveying unit configured to convey a medium. The printer further includes an image forming unit provided in a conveyance path of the medium, the image forming unit being configured to form an image with a temperature-sensitive ink, whose color is changed depending on a temperature, on the medium. A cutter for cutting the medium is provided in the conveyance path downstream of a medium conveyance direction of the image forming unit. Further, a coloring conversion unit is provided in the conveyance path downstream of a medium conveyance direction of the cutter. The coloring conversion unit is configured to change a coloring state of the image of the temperature-sensitive ink by heating or cooling the image of the temperature-sensitive ink formed on the cut medium.

Certain embodiments will now be described in detail with reference to the drawings. The embodiments described below include like components. In the following description, like components will be designated by common reference symbols and will not be described repeatedly.

Figure 1:
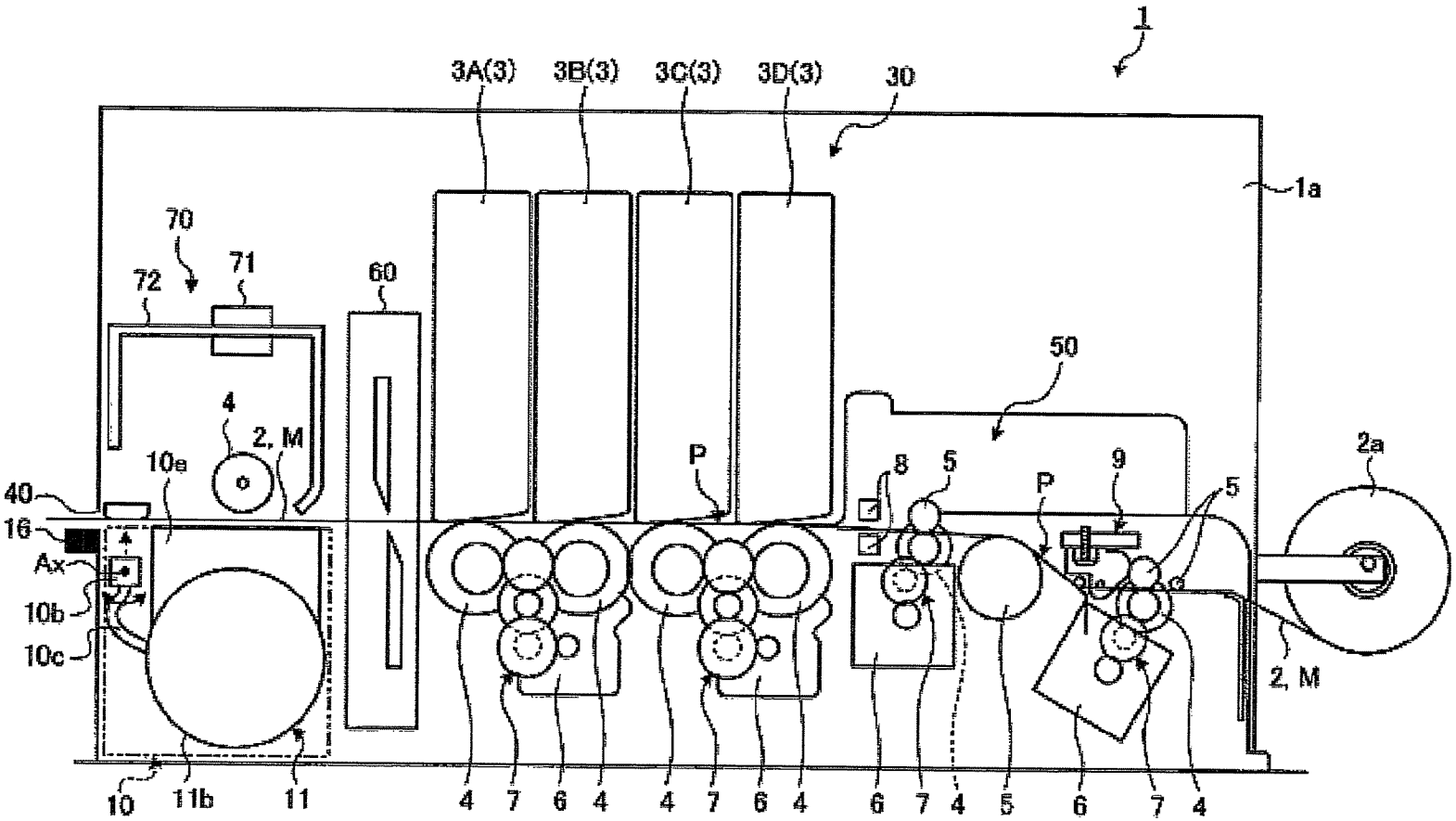
FIG. 1 is a side view illustrating a schematic configuration of a printer according to a first embodiment.

FIG. 1 is a side view illustrating a schematic configuration of a printer according to a first embodiment. In the present embodiment, a printer 1 is made up of, e.g., a thermal printer configured to heat an ink ribbon and transfer an ink to a medium M such as a paper. The medium M may be, e.g., a label like the one shown in FIGS. 10A and 10B. A plurality of media M is attached to a surface of a strip-shaped backing paper 2 at a specified interval (pitch). Notches may be formed on the backing paper 2 so that the media M can be cut away from the backing paper 2.

As shown in FIG. 1, in the printer 1, a conveyance path P is formed with a conveying unit 50 at the inside of a body unit 1*a* to guide a roll 2*a* of the backing paper 2 to a discharge outlet 40. Further, in the printer 1, a print block 30, a cutter 60, and a cooling mechanism 10 are sequentially arranged from upstream toward downstream of a conveyance direction of the medium along the conveyance path P.

The printer 1 includes a body unit 1*a* to which a plurality of (four, in the present embodiment) ink ribbon cartridges 3 (3A through 3D) can be attached in a removable manner. The ink ribbon cartridges 3 are arranged side by side along a conveyance path P of the strip-shaped backing paper 2 defined inside the printer 1. Each of the ink ribbon cartridges 3 includes a head (thermal head) 3*a* and an ink ribbon 3*d* (see FIGS. 11A and 11B). By causing the head 3*a* to heat the ink of the ink ribbon 3*d*, each of the ink ribbon cartridges 3 forms ink images (not shown in FIG. 1) on the medium M conveyed along the conveyance path P. In other words, the head (thermal head) 3*a* of each of the ink ribbon cartridges 3 corresponds to an image forming unit. The number of the ink ribbon cartridges 3 is not limited to four but may be set differently.

A roll 2*a* of the backing paper 2 is removably and rotatably mounted to the body unit 1*a* at the most upstream side of the conveyance path P. Upon rotation of conveying rollers 4, the backing paper 2 is drawn away from the roll 2*a* and conveyed through the conveyance path P.

The conveyance path P is defined not only by the arrangement of the ink ribbon cartridges 3 but also by the arrangement of the conveying rollers 4 and auxiliary rollers 5. The printer 1 includes a plurality of conveying rollers 4 rotationally driven by a motor 6. Rotation of the motor 6 is transmitted to the respective conveying rollers 4 through a rotation-transmitting mechanism (or a speed-reducing mechanism) 7. The printer 1 includes auxiliary rollers 5 arranged in such positions that the auxiliary rollers 5 pinch the backing paper 2 in cooperation with the conveying rollers 4 or in such positions that the backing paper 2 is stretched between the conveying rollers 4 or between the auxiliary rollers 5. The printer 1 further includes a sensor 8 for detecting the medium M and a tension detecting mechanism 9 for detecting the tension of the backing paper 2. In the present embodiment, the motor 6, the rotation-transmitting mechanism 7, the conveying rollers 4 and the auxiliary rollers 5 make up the conveying unit 50 for conveying the backing paper 2 (the medium M).

The print block 30 that forms a portion of the conveyance path P is installed downstream of the conveying unit 50 in the conveyance direction of the medium M. The print block 30 may include an ink ribbon cartridge 3 having an ink ribbon of non-temperature-sensitive ink whose color is not changed depending on a temperature. Further, the print block 30 may include an ink ribbon cartridge 3 having an ink ribbon of temperature-sensitive ink whose color is changed depending on a temperature. Additionally or alternatively, the print block 30 may include an ink ribbon cartridge 3 having a differently-colored ink ribbon (with a non-temperature-sensitive ink or a temperature-sensitive ink). Each of the ink ribbon cartridges 3 can be removably mounted in one of the mounting positions of the ink ribbon cartridges 3 (3A through 3D) provided in the print block 30 of the body unit 1*a*.

Further, the conveying roller 4, which is installed adjacent to the ink ribbon cartridge 3 and opposite to the head (thermal head) 3*a* with the ink ribbon 3*d* interposed therebetween, functions as a so-called platen roller. The conveying roller 4 functioning as a platen roller is disposed at a position below the conveyance path P, and the head (thermal head) 3*a* is provided above the conveyance path P, such that the head 3*a* detachably contacts with the conveying roller 4 through the conveyance path P. In this configuration, the conveying roller 4 is rotationally driven to convey the backing paper 2 (medium M) toward the discharge outlet 40.

Figure 2A:
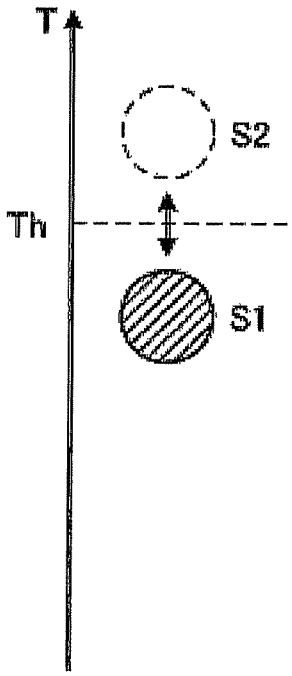
FIGS. 2A and 2B are explanatory views illustrating one example of the temperature-sensitive properties of a temperature-sensitive ink, FIG. 2A depicting the discoloring property of a temperature-sensitive ink having one threshold temperature and FIG. 2B depicting the discoloring property of a temperature-sensitive ink having two threshold temperatures.

Among the temperature-sensitive inks is an ink whose coloring state varies above and below a threshold temperature Th as depicted in FIG. 2A. For example, the temperature-sensitive ink depicted in FIG. 2A becomes white (S2) if the temperature T exceeds the threshold temperature Th but is colored (S1) if the temperature T is equal to or lower than the threshold temperature Th. If the medium M is a white color and the temperature-sensitive ink remains white (S2), the temperature-sensitive ink images formed on the medium M are hard to see or invisible. The temperature-dependent change of the coloring state of the temperature-sensitive ink is reversible.

Figure 2B:
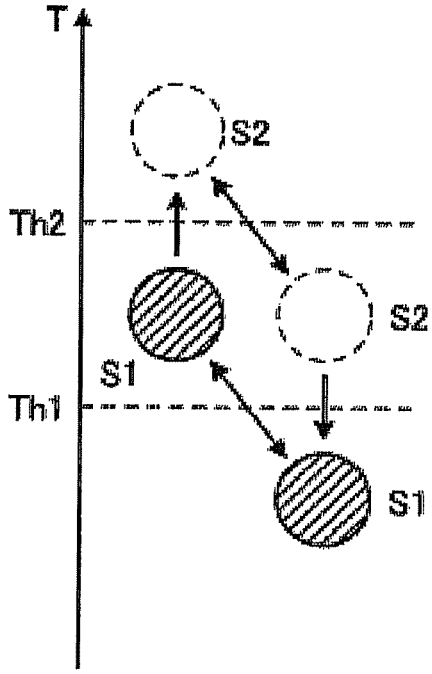

Among the temperature-sensitive inks, there is also an ink whose coloring state varies above and below two different threshold temperatures Th1 and Th2 when the temperature T goes up and down as depicted in FIG. 2B. For example, the temperature-sensitive ink depicted in FIG. 2B remains white (S2) if the temperature T, when going down, is higher than a first threshold temperature Th1 but is colored (S1) if the temperature T, when going down, becomes equal to or lower than the first threshold temperature Th1. If the medium M is a white color and the temperature-sensitive ink remains white (S2), the temperature-sensitive ink images formed on the medium M are hard to see or invisible. The temperature-sensitive ink depicted in FIG. 2B remains colored (S1) if the temperature T, when going up, is equal to or lower than a second threshold temperature Th2 but becomes white (S2) if the temperature T, when going up, grows higher than the second threshold temperature Th2. In this regard, the second threshold temperature Th2 is higher than the first threshold temperature Th1 as can be seen in FIG. 2B. Therefore, as long as the temperature T remains between the first threshold temperature Th1 and the second threshold temperature Th2, the coloring state of the temperature-sensitive ink in the falling process of the temperature T (i.e., changing from a temperature T exceeding the second threshold temperature Th2 to a temperature T equal to or lower than the second threshold temperature Th2) differs from the coloring state of the temperature-sensitive ink in the rising process of the temperature T (i.e., changing from a temperature T equal to or lower than the first threshold temperature Th1 to a temperature T greater than the first threshold temperature Th1). Since many different kinds of temperature-sensitive inks are available, it is possible to appropriately change the threshold temperatures Th, Th1 and Th2 and the coloring states.

In addition, the cutter 60 for cutting the backing paper 2 (medium M) being conveyed along the conveyance path P is installed downstream in the medium conveyance direction of the print block 30. The cutter 60 forms a portion of the conveyance path P.

In the case of a thermal printer, the temperature T goes up during an image forming process (heat transfer process). Therefore, if images with a temperature-sensitive ink whose color is changed to the same color as the medium M at a temperature higher that the threshold temperatures Th, Th1 and Th2 mentioned above are formed on the medium M through the use of the printer 1, it is often impossible or difficult to determine whether the temperature-sensitive ink images are successfully formed on the medium M. Depending on the kinds of temperature-sensitive inks, it is sometimes the case that the temperature-sensitive ink images formed on the medium M are hardly visible at a normal temperature. Therefore, in the present embodiment, the printer 1 includes a cooling mechanism 10 provided as a portion of the conveyance path P downstream in the medium conveyance direction of the cutter 60, which serves as a coloring conversion mechanism for converting the coloring state of temperature-sensitive ink images formed on the medium M. The cooling mechanism 10 is disposed at a lower part of the conveyance path P and in the vicinity of the discharge outlet 40 in the printer 1. In the present embodiment, the temperature T is reduced by, e.g., cooling the temperature-sensitive ink images with the cooling mechanism 10. Thus, the temperature-sensitive ink images get visualized and become readily visible, thereby making it easy to check the formation situation of the temperature-sensitive ink images on the medium M. In other words, the cooling mechanism 10 may be referred to as a coloring conversion mechanism or a visualizing mechanism of temperature-sensitive ink images.

In the present embodiment, the cooling mechanism 10 is configured to spout, e.g., a gas, and reduce the temperature of the medium M, namely the temperature of the temperature-sensitive ink images, using the adiabatic expansion or the latent heat of the gas. More specifically, the cooling mechanism 10 includes a mounting portion 10*a* configured to hold a gas cartridge 11 of a gas cylinder, a spouting portion 10*b*, a tube 10*c*, a valve 10*d* and a cooling fin 10*e*.

The gas cartridge 11 is removably mounted to the mounting portion 10*a*. The mounting portion 10*a* serves as a connector for receiving a connector 11*a* of the gas cartridge 11. The mounting portion 10*a* may include a movable lever (not shown) used in removing the gas cartridge 11 and a lock mechanism (not shown) for fixing the gas cartridge 11 in a mounting position.

The gas cartridge 11 may be made up of, e.g., a gas cylinder (gas bomb) filled with a liquefied gas. As the gas (coolant), it is possible to use, e.g., tetrafluoroethane.

Figure 3:
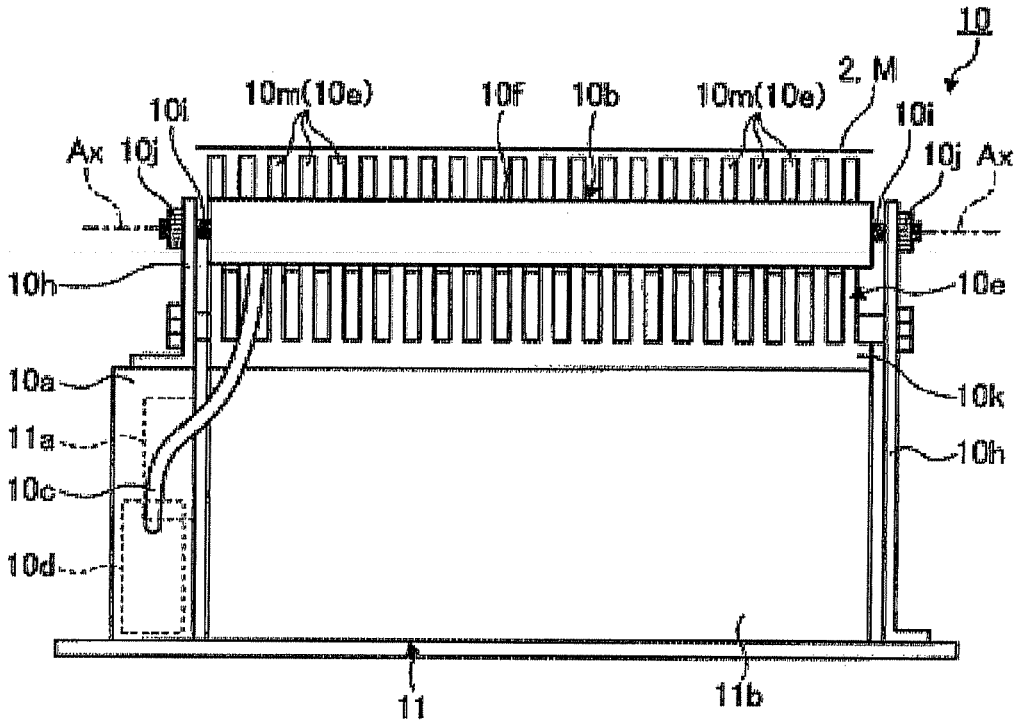
FIG. 3 is a front view showing a cooling mechanism included in the printer.
Figure 5:
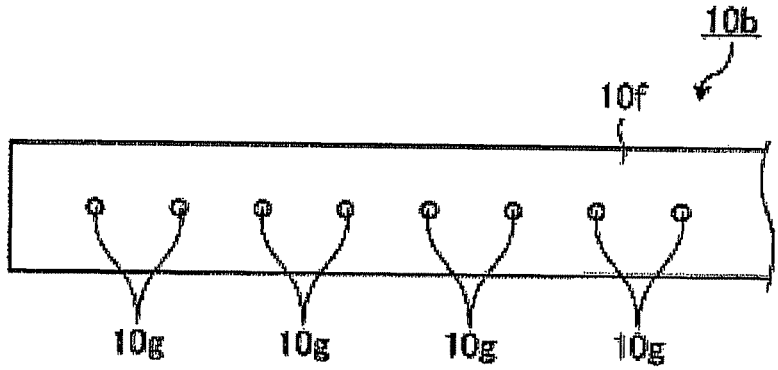
FIG. 5 is a plan view of a portion of the spouting portion of the cooling mechanism shown in FIG. 3, when seen from a front surface of a backing paper.

As shown in FIGS. 1 and 3, the spouting portion 10*b* is arranged to extend in the width direction of the backing paper 2 along the rear surface of the backing paper 2. The spouting portion 10*b* is a gas pipe having a gas flow path formed therein. Referring to FIG. 5, the spouting portion 10*b* has an upper wall 10*f* and a plurality of nozzle holes 10*g* formed side by side in the upper wall 10*f* at a regular interval (pitch). The gas is spouted from the nozzle holes 10*g* toward the rear surface of the backing paper 2. The nozzle holes 10*g* may be arranged in plural rows.

Figure 4A:
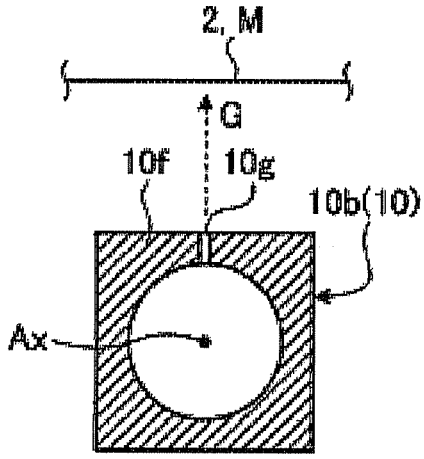
FIGS. 4A and 4B are section views showing a spouting portion included in the cooling mechanism shown in FIG. 3, FIG. 4A illustrating a state in which a gas is spouted at a right angle with respect to a medium and FIG. 4B illustrating a state in which the gas is obliquely spouted with respect to the medium.
Figure 4B:
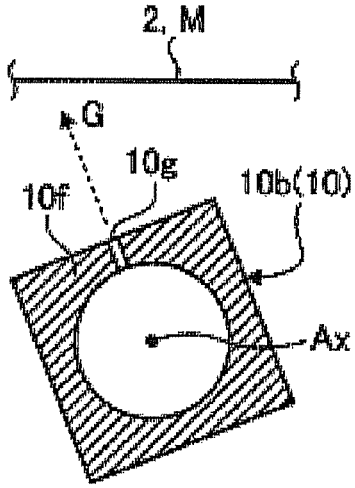

The spouting portion 10*b* is supported by brackets 10*h* to rotate about a rotation axis Ax extending in the width direction of the backing paper 2 and is capable of changing the spouting angle (spouting direction) of the gas G as illustrated in FIGS. 4A and 4B. More specifically, as shown in FIG. 3, the spouting portion 10*b* can be fixed at an arbitrary angle by arranging the spouting portion 10*b* at a specified spouting angle and then tightening nuts 10*j* to the male screw portions 10*i* of the spouting portion 10*b* inserted into the through-holes (not shown) of the brackets 10*h*. The cooling degree of the backing paper 2 cooled by the gas G can be variably set by variably setting the spouting angle. For instance, cooling is more heavily performed in the arrangement shown in FIG. 4A than in the arrangement shown in FIG. 4B. Thus, the temperature-sensitive ink images formed on the medium M have a lower temperature in the arrangement shown in FIG. 4A than in the arrangement shown in FIG. 4B. In the present embodiment, the spouting portion 10*b* includes a spouting condition adjusting mechanism as set forth above.

The tube 10*c* has pressure resistance and flexibility required for the tube 10*c* to serve as a gas conduit between the mounting portion 10*a* and the spouting portion 10*b* regardless of the change of the angle of the spouting portion 10*b*.

The valve 10*d* can switch the spouting of the gas from the spouting portion 10*b* and the blocking of the gas by opening or closing a gas flow path extending from the gas cartridge 11 to the spouting portion 10. The valve 10*d* may be made up of, e.g., a solenoid valve which is opened in response to an electric signal supplied from a CPU 20*a* (see FIG. 8). The valve 10*d* can be attached to the mounting portion 10*a*. The spouting condition of the gas can be variably set by controlling the opening and closing of the valve 10*d* (e.g., the length of opening time, the number of repetition of opening and closing, and the period of repetition of opening and closing).

The cooling fin 10*e* includes a base portion 10*k* close to or adjoining the outer circumferential surface 11*b* of the gas cartridge 11 and a plurality of plate-shaped portions 10*m* extending in the conveying direction and protruding from the base portion 10*k* toward positions near the rear surface of the backing paper 2. When the temperature of the gas cartridge 11 is reduced by spouting the gas, the cooling fin 10*e* can enhance the cooling performance for the medium M. The cooling mechanism 10 can be removably mounted to the body unit 1*a*.

Further, a blocking unit 70 is provided between the cooling mechanism 10 and the print block 30 and blocks air cooled by the cooling mechanism 10 from staying at a predetermined point while preventing at least a portion of the air cooled by the cooling mechanism 10 from flowing into the print block 30. The blocking unit 70 has a blower 71 configured to blow air cooled by the cooling mechanism 10 and a guide 72 configured to guide the air blown by the blower 71 such that the air does not reach the print block 30. In one embodiment, the blocking unit 70 may further include a conveying roller 4 (see FIG. 7) configured to convey the medium M. The conveying roller 4 may control the conveyance speed such that the medium M can stay in the blocking unit 70 for a predetermined period of time, thereby adjusting the cooling/heating duration of the medium M in the blocking unit 70.

Figure 6:
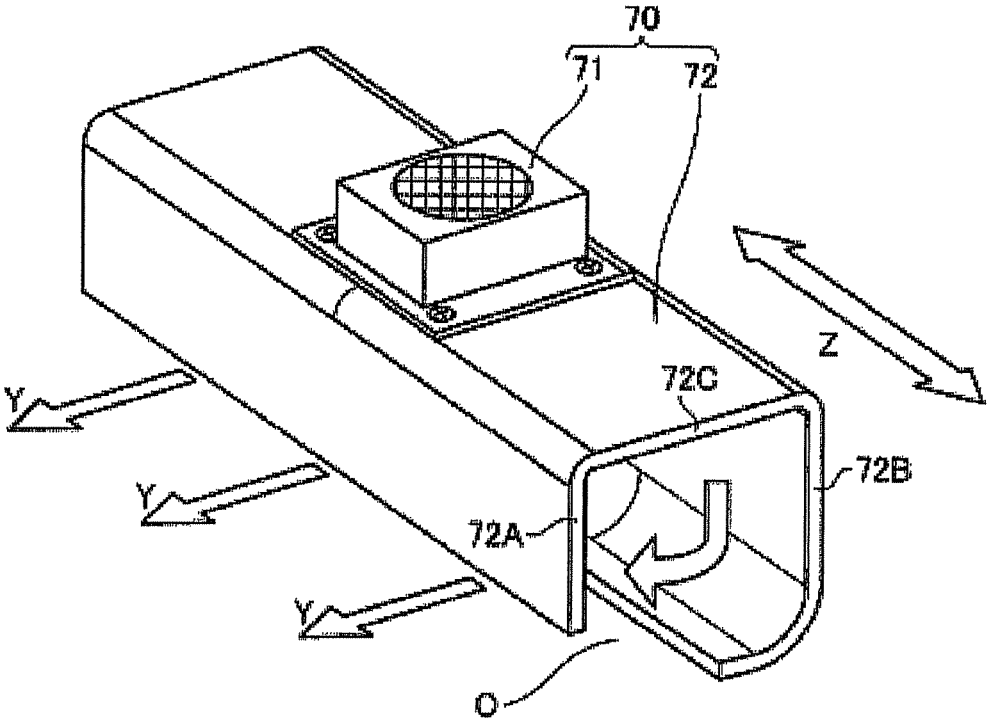
FIG. 6 is a perspective view of a blocking unit.

FIG. 6 is a perspective view illustrating the blocking unit 70 according to one embodiment. As shown in FIG. 6, the guide 72 of the blocking unit 70 is a member formed as a portion of the conveyance path P, the member configured to guide air blown by the blower 71 toward downstream of the medium conveyance direction of the medium M. The guide 72 may be formed with, for example, a metal material or a resin material. The guide 72 includes a front wall portion 72A disposed in the downstream side of the medium conveyance direction of the conveyance path P, a rear wall portion 72B disposed opposite the front wall portion 72A, and a ceiling surface portion 72C disposed in parallel to the conveyance path P, the ceiling surface portion 72C connecting the front wall portion 72A and the rear wall portion 72B above the conveyance path P.

Figure 7:
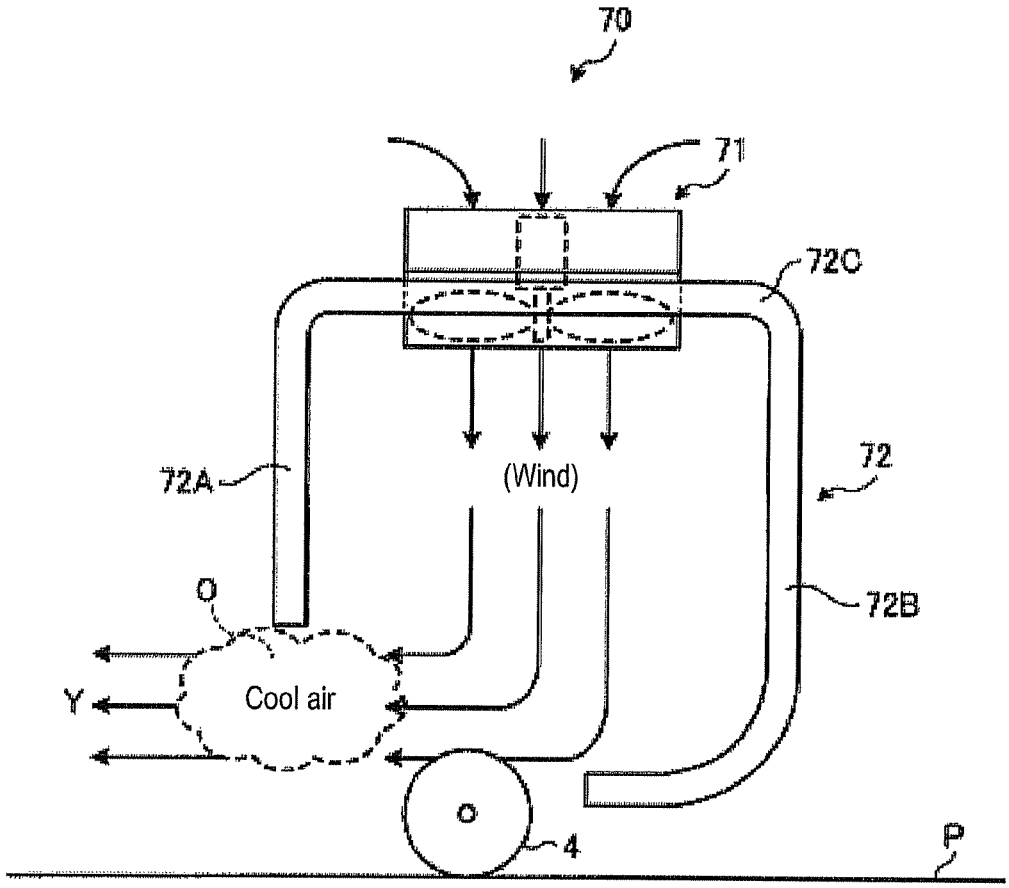
FIG. 7 is a side view illustrating a side surface of a blocking unit.

FIG. 7 is a side view of the blocking unit 70. As shown in FIG. 7, a side cross-section of the guide 72 of the blocking unit 70 has an approximately concave shape. Further, a length of the guide 72 in its width direction Z is approximately equal to a width of the conveyance path P, and the guide 72 is disposed adjacent the upper surface side of the conveyance path P and aligned with the width of the conveyance path P.

The guide 72 having the above configuration guides air (wind) blown from the blower 71 toward the cooling mechanism 10 disposed below the blower 71 and discharges the air Y cooled in the cooling mechanism 10 through a discharge outlet O formed in a lower part of the front wall portion 72A.

Further, the conveying roller 4 is installed in the blocking unit 70. The conveying roller 4 is disposed above or in contact with the conveyance path P, and additionally in contact with the cooling mechanism 10 through the conveyance path P. By such a structure, as the conveying roller 4 is rotationally driven to apply a conveyance force to the backing paper 2 (medium M), the backing paper 2 (medium M) is conveyed toward the discharge outlet 40.

Further, as shown in FIG. 1, the printer 1 includes a dew condensation removing member 16 in the body unit 1*a* at the periphery of the discharge outlet 40. The dew condensation removing member 16 may be formed of, for example, a sponge material or a rubber scoop. As the dew condensation removing member 16 is provided in the body unit 1*a* at the periphery of the discharge outlet 40, while the backing paper 2 is discharged from the discharge outlet 40 and the medium M attached on the backing paper 2 is colored, small amounts of moisture generated by dew condensation on the backing paper 2 can be removed. The removal of such moisture facilitates treatment of a printed and cut label (because the printed label may become easily detached from a cutting unit).

Figure 8:
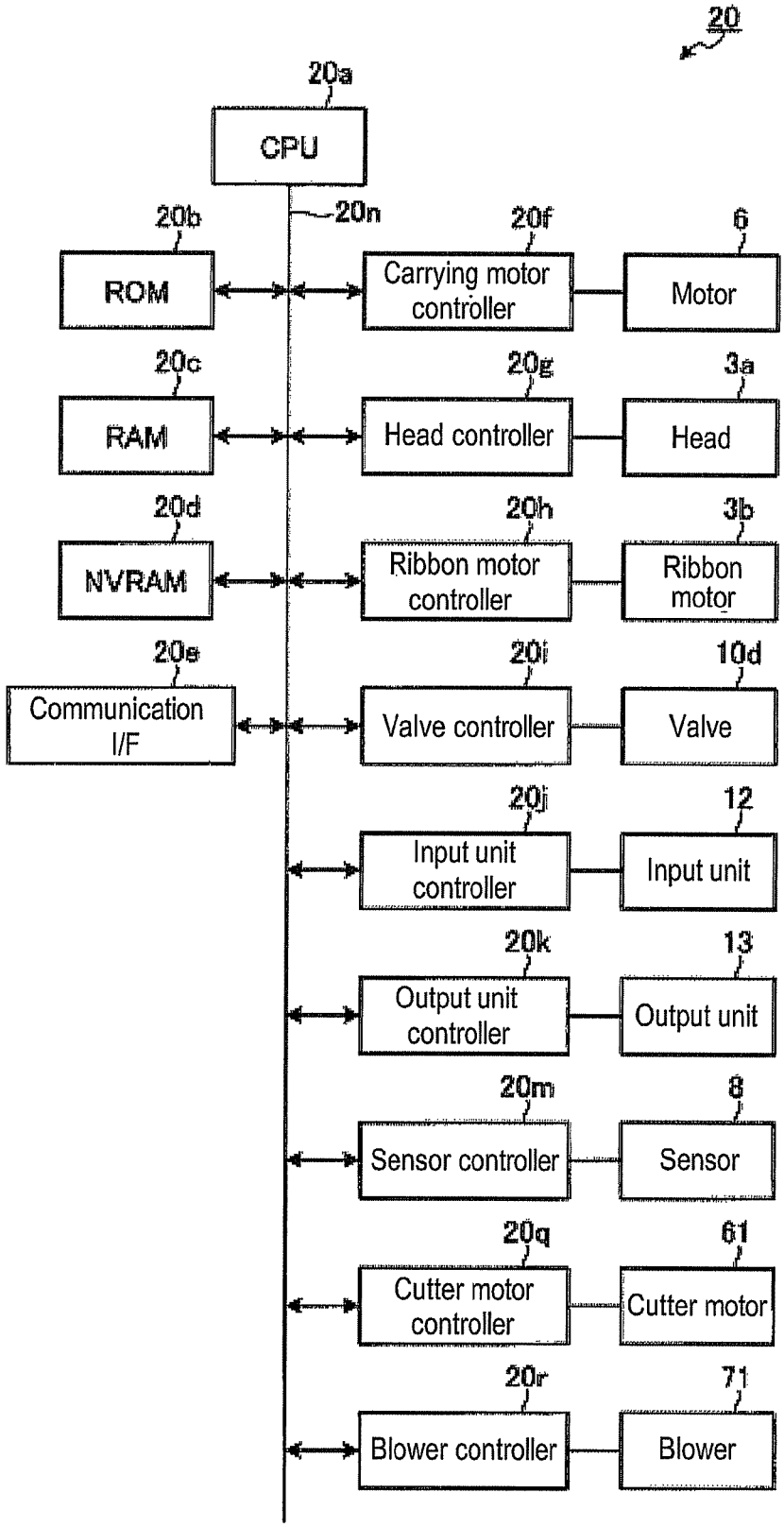
FIG. 8 is a block diagram showing one example of a control circuit included in the printer.

Further, as shown in FIG. 8, the control circuit 20 of the printer 1 includes a CPU (Central Processing Unit) 20*a* as a control unit, a ROM (Read Only Memory) 20*b*, a RAM (Random Access Memory) 20*c*, an NVRAM (Non-Volatile Random Access Memory) 20*d*, a communication interface (I/F) 20*e*, a conveying motor controller 20*f*, a head controller 20*g*, a ribbon motor controller 20*h*, a valve controller 20*i*, an input unit controller 20*j*, an output unit controller 20*k* a sensor controller 20*m*, a cutter motor controller 20*q*, and a blower controller 20*r*, all of which are connected to one another through a bus 20*n* such as an address bus or a data bus.

The CPU 20*a* controls each unit of the printer 1 by executing various kinds of computer-readable programs stored in the ROM 20*b* or other places. The ROM 20*b* stores, e.g., various kinds of data processed by the CPU 20*a* and various kinds of programs (such as a basic input/output system abbreviated as BIOS, an application program and a device driver program) executed by the CPU 20*a*. The RAM 20*c* temporarily stores data and programs while the CPU 20*a* executes various kinds of programs. The NVRAM 20*d* stores, e.g., an OS (Operating System), an application program, a device driver program and various kinds of data which are to be kept intact even when the power is turned off.

Further, the communication interface (I/F) 20*e* controls data communication with other devices connected through telecommunication lines.

The conveying motor controller 20*f* controls the motor 6 pursuant to an instruction supplied from the CPU 20*a*. The head controller 20*g* controls the head 3*a* (see FIG. 11) in response to an instruction supplied from the CPU 20*a*. The ribbon motor controller 20*h* controls a ribbon motor 3*b* built in each of the ink ribbon cartridges 3 according to an instruction supplied from the CPU 20*a*. The valve controller 20*i* controls the valve 10*d* (the solenoid of the valve 10*d*) of the cooling mechanism 10 based on an instruction supplied from the CPU 20*a*.

The cutter motor controller 20*q* controls driving of a cutter motor 61, which in turn drives the cutter 60, based on an instruction from the CPU 20*a*. Further, the blower controller 20*r* controls driving of the blower 71 of the blocking unit 70 based on an instruction from the CPU 20*a*.

The input unit controller 20*j* transmits to the CPU 20*a* signals inputted through an input unit 12 (e.g., push buttons, a touch panel, a keyboard, a microphone, knobs or DIP switches) for inputting manual operations or voices of a user. The output unit controller 20*k* controls an output unit 13 (e.g., a display, a light-emitting unit, a speaker or a buzzer) for outputting images or voices pursuant to an instruction supplied from the CPU 20*a*. The sensor controller 20*m* transmits to the CPU 20*a* a signal indicative of the detection result of a sensor 8.

Figure 9:
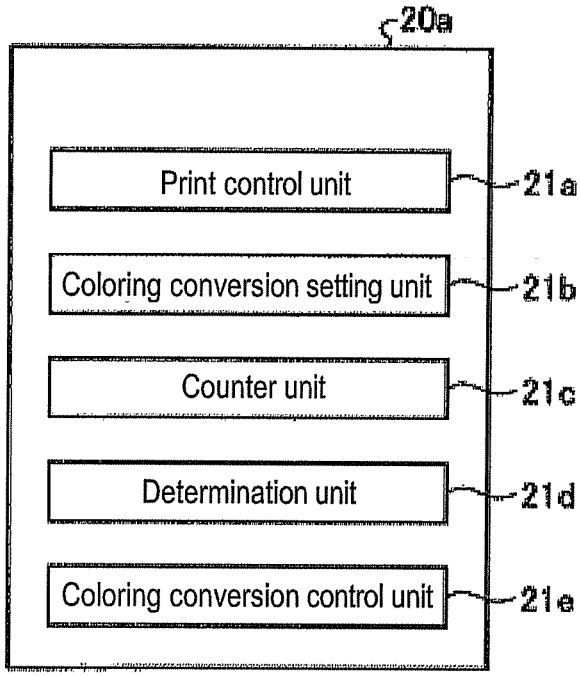
FIG. 9 is a block diagram showing one example of a CPU included in the printer.

Referring back to FIG. 9, the CPU 20*a* as a control unit works as a print control unit 21*a*, a coloring conversion setting unit 21*b*, a counter unit 21*c*, a determination unit 21*d* and a coloring conversion control unit 21*e* according to the programs executed. The programs contain modules corresponding to at least the print control unit 21*a*, the coloring conversion setting unit 21*b*, the counter unit 21*c*, the determination unit 21*d* and the coloring conversion control unit 21*e*.

The print control unit 21*a* controls the motor 6, the head 3*a*, the ribbon motor 3*b*, and the cutter motor 61 through the conveying motor controller 20*f*, the head controller 20*g*, the ribbon motor controller 20*h* and the cutter motor controller 20*q*. Images such as letters or pictures are formed on the medium M under the control of the print control unit 21*a*. A character or an image is formed on the medium M by operation of the print control unit 21*a*. Further, by operation of the print control unit 21*a*, the backing paper 2 (medium M) on which an image is formed is cut by the cutter 60 positioned downstream of the medium conveyance direction of the print block 30 on the conveyance path P and is conveyed to the cooling mechanism 10.

The coloring conversion setting unit 21*b* performs various kinds of setting operations associated with the coloring conversion of the temperature-sensitive ink images printed on the medium M (the cooling performed by the cooling mechanism 10 in the present embodiment). More specifically, the coloring conversion setting unit 21*b* can cause the storage unit such as the NVRAM 20*d* to store a pitch (frequency) at which coloring conversion (cooling) is performed with respect to the medium M and a parameter for setting the opening or closing conditions of the valve 10*d* (e.g., the opening/closing timing, the opening/closing duration, the number of opening/closing times and the opening/closing time period), which are inputted through the input unit 12.

The counter unit 21*c* counts the number of the media M (or the number of image formation areas) detected by the sensor 8. The determination unit 21*d* compares the count value counted by the counter unit 21*c* with the pitch (frequency) stored in the storage unit and determines whether to perform coloring conversion (cooling in the present embodiment). The coloring conversion control unit 21*e* controls each part or unit (the respective parts of the cooling mechanism 10 in the present embodiment) in order to perform coloring conversion (cooling in the present embodiment) with respect to the medium M (the temperature-sensitive ink images formed on the medium M) that is determined to be subjected to coloring conversion. In the present embodiment, the coloring conversion control unit 21*e* performs the coloring conversion of the medium M by controlling the opening/closing state of the valve 10*d* and consequently controlling the spouting state of the gas. The coloring conversion control unit 21*e* also corresponds to the spouting condition adjusting mechanism. In the present embodiment, pursuant to the setting of the pitch (frequency), the coloring conversion can be performed with respect to the temperature-sensitive ink images formed on all the media M or some of the media M.

Figure 10A:
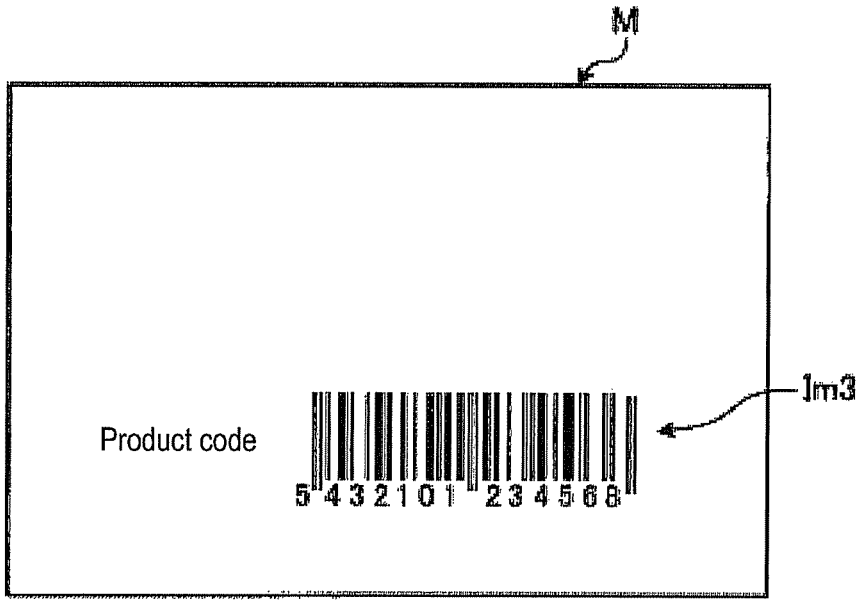
FIGS. 10A and 10B are views showing one example of a product label as a medium obtained in the printer, FIG. 10A illustrating a state in which images with a temperature-sensitive ink are hard to see (invisible) and FIG. 10B illustrating a state in which images with a temperature-sensitive ink are easy to see (visible).
Figure 10B:
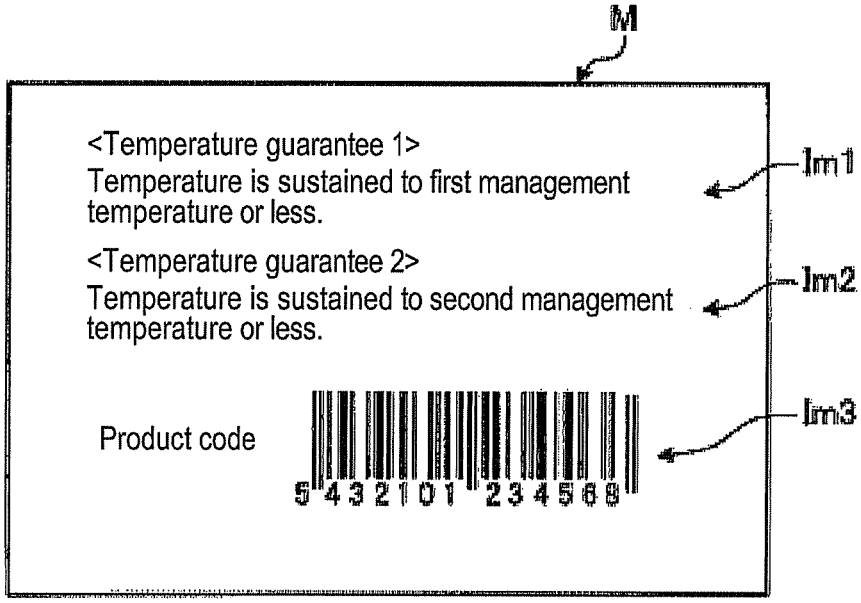

The printer 1 configured as above can produce, e.g., a medium M as illustrated in FIG. 10A or 10B. FIG. 10A illustrates a product label as a medium M outputted from the printer 1 with no cooling performed by the cooling mechanism 10. FIG. 10B illustrates a product label as a medium M outputted from the printer 1 with the cooling performed by the cooling mechanism 10. The temperature-sensitive ink images Im1 and Im2 are visualized when the cooling is performed by the cooling mechanism 10. Accordingly, a user or an operator of the printer 1 is easily able to visually recognize the formation of the temperature-sensitive ink images Im1 and Im2 on the medium M. FIGS. 10A and 10B illustrate a case where images Im1 and Im2 of two kinds of temperature-sensitive inks differing in threshold temperature Th are formed on the medium M. Moreover, an image Im3 (e.g., a barcode) formed by a typical ink whose coloring state is not changed by the temperature is also formed on the medium M.

As one example, the medium M illustrated in FIGS. 10A and 10B can be used for temperature management in refrigerating or freezing a product. More specifically, the medium M on which the images Im1 and Im2 of the temperature-sensitive ink having the temperature-sensitive property depicted in FIG. 2A formed by the printer 1 is used as a product label. The printer 1 utilizes a temperature-sensitive ink having a threshold temperature Th as a management temperature (e.g., 5 degrees Celsius) that a product to be refrigerated or frozen is not allowed to exceed. As a result, if a product temperature exceeds the threshold temperature Th, the medium M comes into the state as illustrated in FIG. 10A. Thus, the temperature-sensitive ink images Im1 and Im2 become hard to see or invisible (S2 in FIG. 2A). On the other hand, if the product temperature is equal to or lower than the threshold temperature Th as the management temperature, the medium M is kept in the state illustrated in FIG. 10B (S1 in FIG. 2A). This enables a worker or other persons to determine whether the product temperature is higher than or lower than the management temperature, based on whether the temperature-sensitive ink images Im1 and Im2 are easy to see (visible) or hard to see (invisible). In the example illustrated in FIGS. 10A and 10B, the images Im1 and Im2 of two kinds of temperature-sensitive inks differing in the threshold temperature Th are formed on the medium M to thereby indicate the product management results in respect of two kinds of management temperatures (first and second management temperatures). In this example, the formation condition of the temperature-sensitive ink images Im1 and Im2 on the medium M can be visually confirmed by cooling the medium M with the cooling mechanism 10.

As another example, images Im1 and Im2 of a temperature-sensitive ink with a temperature-sensitive property showing a hysteresis in temperature rising and falling processes as depicted in FIG. 2B can be formed by the printer 1 on a product label as a medium M illustrated in FIGS. 10A and 10B. In this case, the printer 1 forms the images Im1 and Im2 on the medium M through the use of a temperature-sensitive ink having a threshold temperature Th2 as a management temperature (e.g., −5 degrees Celsius) that a product to be refrigerated or frozen is not allowed to exceed and a threshold temperature Th1 as a temperature (e.g., −30 degrees Celsius) that cannot be realized in a specified refrigerating or freezing state. In the printer 1, the cooling mechanism 10 cools the images Im1 and Im2 to the threshold temperature Th1 or lower (e.g., −40 degrees Celsius) so that the images Im1 and Im2 formed by the printer 1 can be visualized on the medium M. In the case of this example, all of the media M are cooled by the cooling mechanism 10 to first reduce the temperature of the media M to the threshold temperature Th1 or lower. As a result, if a product temperature exceeds the threshold temperature Th2 as the management temperature even for a single time, the medium M comes into the state illustrated in FIG. 10A. Thus, the temperature-sensitive ink images Im1 and Im2 become hard to see or invisible (S2 in FIG. 2B) and continue to remain in this state (S2). On the other hand, if the product temperature is equal to or lower than the threshold temperature Th2 as the management temperature, the medium M is kept in the state illustrated in FIG. 10B (S1 in FIG. 2B). This enables a worker or other persons to determine whether the product temperature has ever exceeded the management temperature before, based on whether the temperature-sensitive ink images Im1 and Im2 are easy to see (visible) or hard to see (invisible). In this example, the images Im1 and Im2 of two kinds of temperature-sensitive inks differing in the threshold temperature Th2 are formed on the medium M to thereby indicate the product management results in respect of two kinds of management temperatures (first and second management temperatures).

Figure 11A:
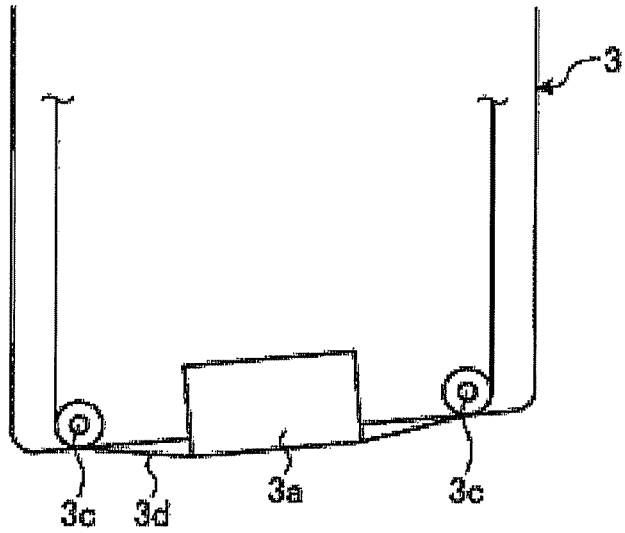
FIGS. 11A and 11B are side views schematically showing portions of ink ribbon cartridges included in the printer, FIG. 11A illustrating an ink ribbon cartridge having a long contact section over which an ink ribbon makes contact with a medium and FIG. 11B illustrating an ink ribbon cartridge having a short contact section over which an ink ribbon makes contact with a medium.
Figure 11B:
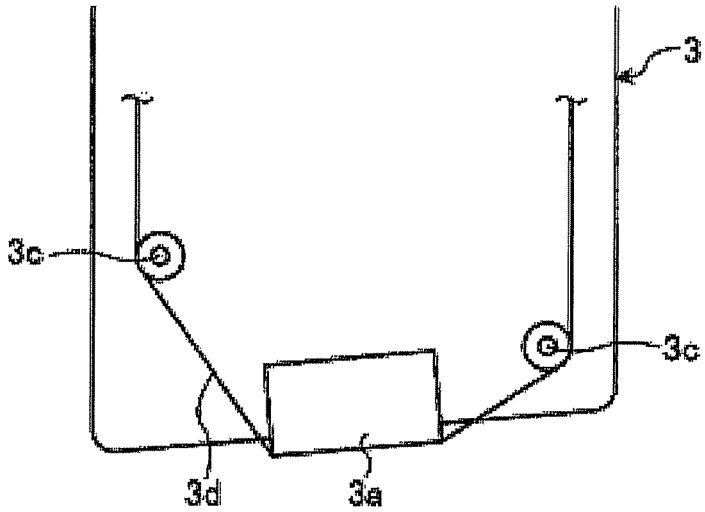

In the printer 1 of the present embodiment, as shown in FIGS. 11A and 11B, it is possible to use ink ribbon cartridges 3 that differ from each other in the positions of the ribbon rollers 3*c* with respect to the head 3*a*. In the configuration shown in FIG. 11A, the ink ribbon 3*d* and the medium M make contact with each other for a long period of time. In the configuration shown in FIG. 11B, the ink ribbon 3*d* and the medium M make contact with each other for a short period of time. One of these configurations can be selected depending on the properties of the temperature-sensitive ink or the non-temperature-sensitive ink. In the present embodiment, the ink ribbon cartridge 3 corresponds to an ink ribbon holding unit. The ribbon motor 3*b* and the ribbon rollers 3*c* make up a ribbon conveying unit.

In the printer 1 of the present embodiment described above, the head 3*a* of the ink ribbon cartridge 3 as an image forming unit forms temperature-sensitive ink images on the medium M and the cooling mechanism 10 as a coloring conversion mechanism converts the coloring of the images. According to the present embodiment, it is therefore possible to impart desired coloring states to the temperature-sensitive ink images formed on the medium M outputted from the printer 1. It is also easy to confirm whether desired temperature-sensitive ink images are successfully formed on the medium M.

In the present embodiment, the cooling mechanism 10 as a coloring conversion mechanism reduces the temperature of the images by spouting a gas. This makes it possible to obtain the cooling mechanism 10 with a relatively simple structure.

In the present embodiment, the printer 1 includes, as the spouting condition adjusting mechanism for adjusting the spouting condition of the gas, a mechanism for adjusting the posture of the spouting portion 10*b* (e.g., the spouting direction of the gas G spouted from the nozzle holes 10*g*) and a mechanism for variably setting the gas spouting timing or the gas spouting time period (e.g., the opening/closing time period of the valve 10*d*). This makes it possible to suitably adjust the condition of the cooling performed by the gas.

Figure 12:
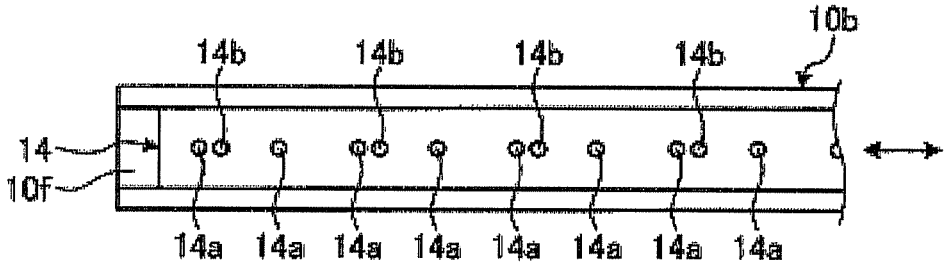
FIG. 12 is a plan view showing a movable plate included in a printer according to a modified example of the first embodiment.

As the spouting condition adjusting mechanism, it is possible to employ, e.g., a movable plate 14 for changing the number of effective nozzle holes 10*g* as shown in FIG. 12. The movable plate 14 is supported on the upper wall 10*f* of the spouting portion 10*b* to movably slide along the upper wall 10*f*. The movable plate 14 has through-holes 14*a* overlapping with all of the nozzle holes 10*g* when the movable plate 14 is in one position and through-holes 14*b* overlapping with some of the nozzle holes 10*g* when the movable plate 14 is in another position. By sliding the movable plate 14, it is possible to switch a state in which the gas is spouted from all of the nozzle holes 10*g* through the through-holes 14*a* and a state in which the gas is spouted from some of the nozzle holes 10*g* through the through-holes 14*b*. This makes it possible to variably set the amount of the spouting gas, thereby variably setting the cooling degree of the temperature-sensitive ink images.

In the present embodiment, the printer 1 includes the heads 3*a* of the ink ribbon cartridges 3 as a plurality of image forming units for forming images with different temperature-sensitive inks on the medium M. Accordingly, a plurality of ink images differing in temperature-sensitive property can be formed on the medium M, which makes it possible to perform temperature management in multiple stages.

In the present embodiment, the cooling mechanism 10 cools the temperature-sensitive ink image extracted (selected or designated) and converts the coloring state thereof. This configuration can reduce energy consumption as compared with a case where all the temperature-sensitive ink images are cooled.

Figure 13:
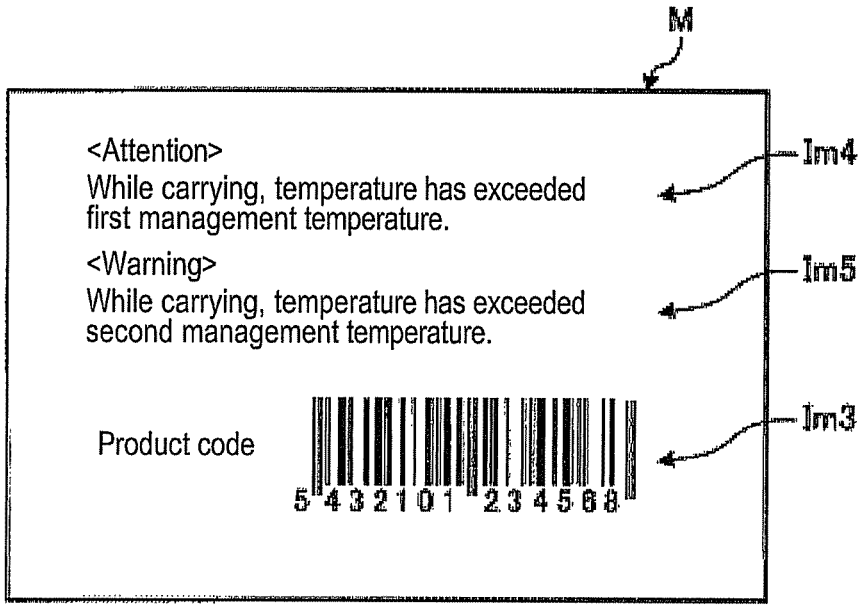
FIG. 13 is a view showing one example of a product label as a medium obtained in the printer according to the modified example of the first embodiment.

In the printer 1, it is also possible to use a temperature-sensitive ink having a property opposite to the property of the temperature-sensitive ink stated above, namely a temperature-sensitive ink having such property that the temperature-sensitive ink is visualized when the temperature thereof exceeds a management temperature. For example, as shown in FIG. 13, if the ink temperature is higher than the threshold temperature, a message of "caution" or "warning" indicating that the temperature of the temperature-sensitive ink image Im4 or Im5 has exceeded the management temperature appears on the medium M as a product label. In this example, images Im4 and Im5 of temperature-sensitive inks differing in the threshold temperature are formed on the medium M, which makes it possible to manage a product at different temperatures. In the printer 1 corresponding to the example shown in FIG. 13, a heating mechanism instead of the cooling mechanism 10 can be provided as the coloring conversion mechanism. In this example, it is equally possible to form the temperature-sensitive ink images Im4 and Im5 over a non-temperature-sensitive ink image Imb formed on the medium M. In this example, the temperature-sensitive ink images Im4 and Im5 are visualized to issue a caution notice or a warning notice when a specified temperature condition is not satisfied.

The present embodiment may resolve the problem that it cannot be determined whether a desired image of temperature-sensitive ink is formed on the medium M after the medium M is cut by the cutter. This problem occurs when an image of temperature-sensitive ink formed on the medium M, whose coloring state is changed by the cooling mechanism 10 as a coloring conversion unit, disappears due to a factor such as a temperature increase until the medium M is cut by the cutter 60. However, according to the present embodiment, the cutter 60 is provided upstream of the cooling mechanism 10 as a coloring conversion unit. This makes it possible to determine the coloring state of the image of temperature-sensitive ink immediately after the medium M having an image of temperature-sensitive ink formed thereon, whose coloring state has been changed by the coloring conversion unit, is discharged from a discharge outlet. Thus, in forming an image of temperature-sensitive ink on the medium M in a printer, the above problem caused by a change in the coloring of the temperature-sensitive ink can be resolved.

The following is a description of a second embodiment of the present disclosure. Further, the same elements as those of the first embodiment are denoted by the same reference numerals and a description thereof will be omitted.

Figure 14:
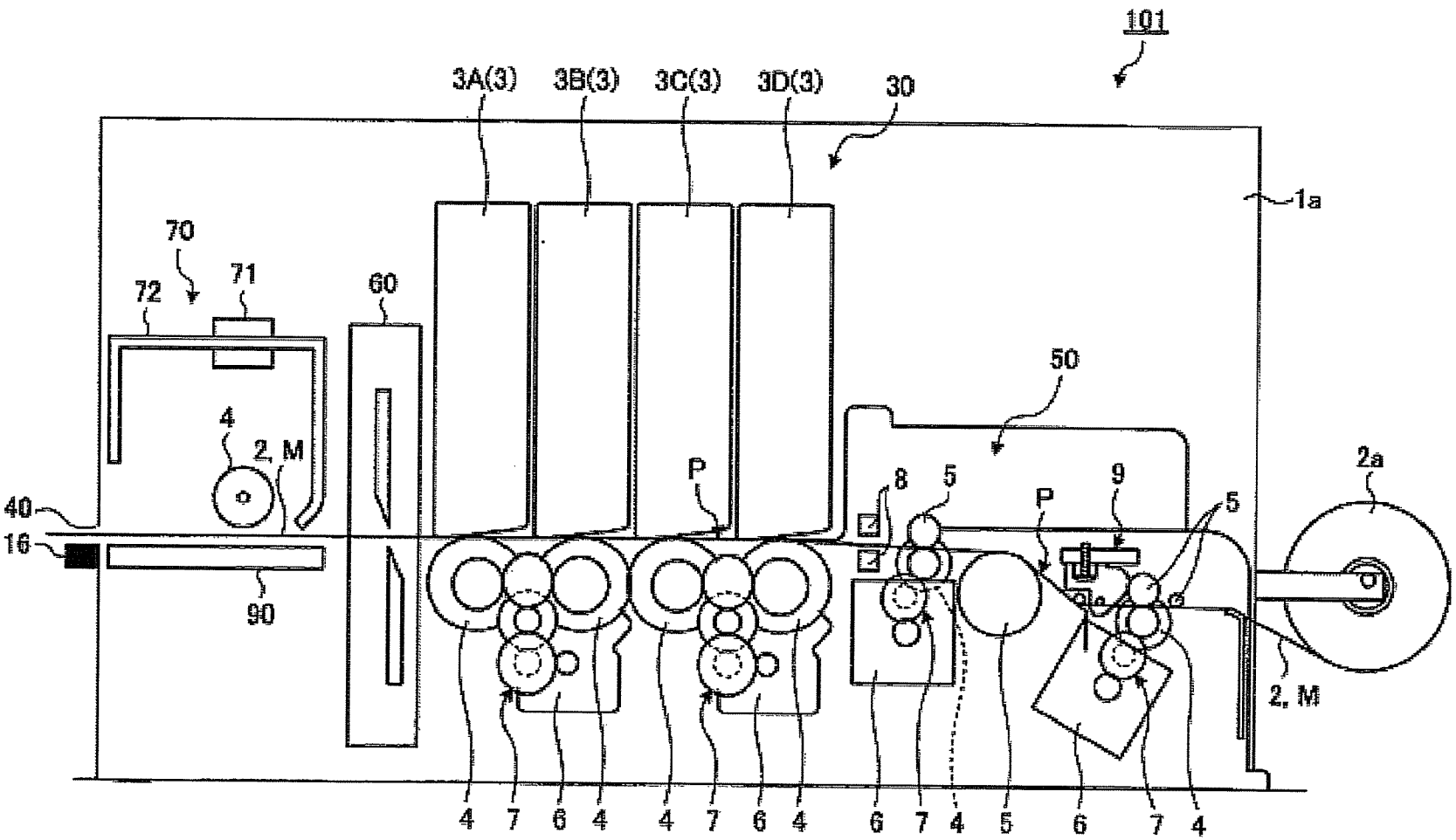
FIG. 14 is a side view showing a schematic configuration of a printer according to a second embodiment.

FIG. 14 is a side view illustrating a schematic configuration of a printer according to a second embodiment. As shown in FIG. 14, a printer 101 according to the present embodiment disposes a cooling element 90 as a coloring conversion unit, instead of the cooling mechanism 10 of the printer 1 of the first embodiment, below the conveyance path P. The cooling element 90 may be implemented using, for example, a Peltier element. The Peltier element is cooled by air blown by the blower 71 of a blocking unit 70. The blocking unit 70 includes the conveying roller 4 (see FIG. 7), which controls the cooling/heating duration of the medium M by controlling the conveyance speed of the medium M.

Figure 15:
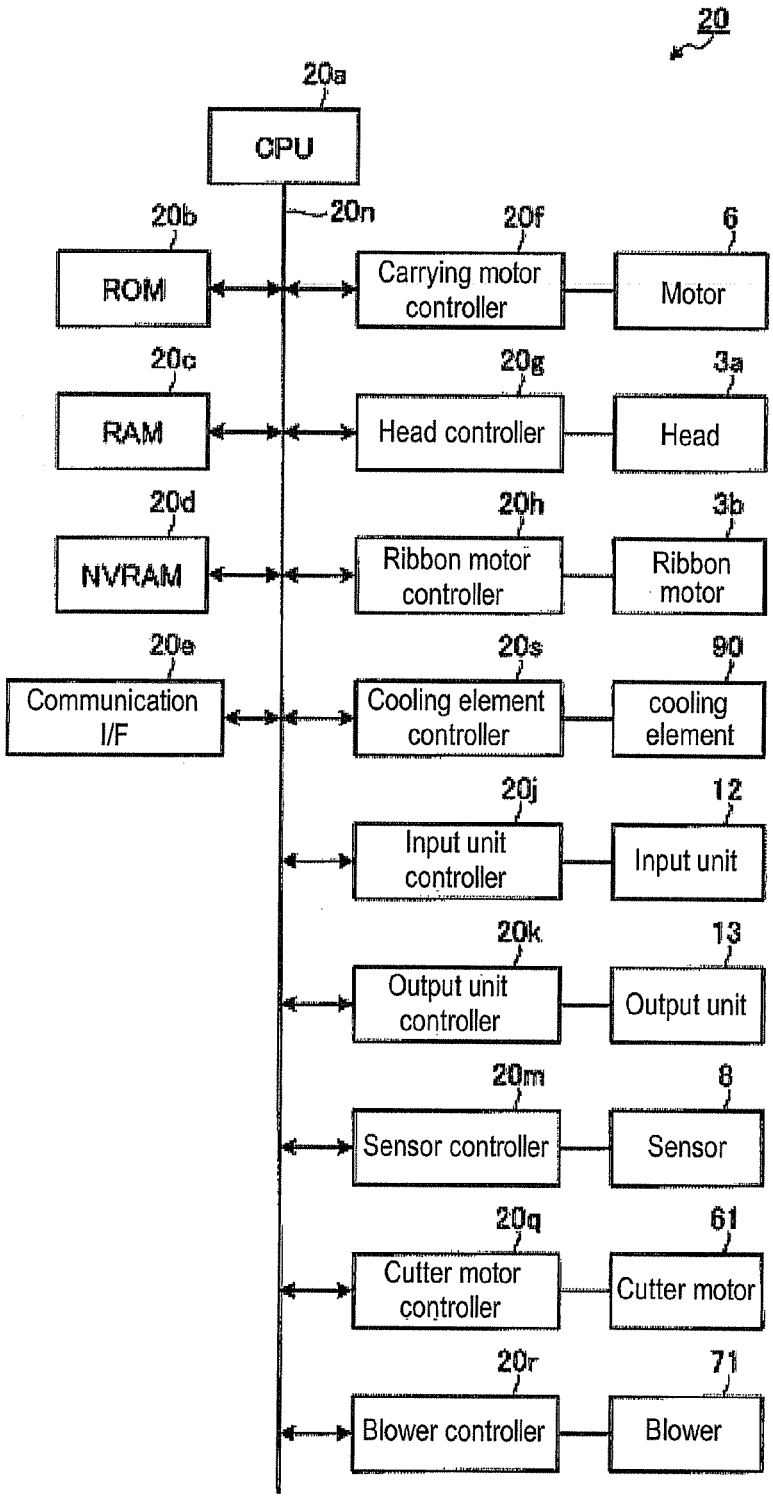
FIG. 15 is a block diagram illustrating an exemplary control circuit included in a printer.

The operation of the cooling element 90 is controlled by a cooling element controller 20*s* based on an instruction from a CPU 20*a*, as shown in FIG. 15.

According to the present embodiment, the cooling element 90 (provided instead of the cooling mechanism 10 in the printer 1 of the first embodiment) can be implemented at a smaller size, compared with the cooling mechanism 10 of the printer 1 of the first embodiment. This results in a decrease in the size of the printer. Also, in performing the cooling process, a change in humidity decreases, and noise and vibration can be suppressed.

While certain preferred embodiments have been described above, the present disclosure is not limited thereto but may be modified in many different forms. For example, the printer may include three or more image forming units for forming images with different temperature-sensitive inks. The printer may include both the cooling mechanism and the heating mechanism as the coloring conversion mechanism. In this case, one of the cooling mechanism and the heating mechanism may be caused to act on the temperature-sensitive ink images to first bring the images into an easy-to-see (visible) state. Thereafter, the other may be caused to act on the temperature-sensitive ink images to bring the images into a hard-to-see (invisible) state (namely, to return the images to the original state). This enables a worker or other persons to confirm the temperature-sensitive ink images in the easy-to-see (visible) state. The number of the cooling mechanism and the heating mechanism may be changed to many other numbers.

The printer may include a spouting portion for spouting a cold gas or a hot gas as the cooling mechanism or the heating mechanism. A cold gas or a hot gas can be fed from the outside to the spouting portion through a connector and a pipe. In this configuration, it is possible to omit the gas cartridge, which makes it possible to reduce the size of the printer proportionate to the omission of the gas cartridge.

The printer may be configured from a printer of another type using ink (e.g., an inkjet printer). In case of an inkjet printer, an ink head corresponds to the image forming unit.

The specifications (type, structure, shape, size, arrangement, position, number, constituent or temperature-sensitive property) of the respective components (the print system, the printer, the medium, the ink ribbon cartridge, the image forming unit, the coloring conversion mechanism, the cooling mechanism, the heating mechanism, the spouting condition adjusting mechanism, the coloring conversion device, the image or the temperature-sensitive ink) may be appropriately modified and embodied.

According to the above embodiments and modified examples, in forming an image of temperature-sensitive ink on the medium M in a printer, the problems caused by the change in the coloring of the temperature-sensitive ink can be resolved.

While certain embodiments have been described, these embodiments have been presented by way of example only, and are not intended to limit the scope of the disclosures. Indeed, the novel apparatuses described herein may be embodied in a variety of other forms; furthermore, various omissions, substitutions and changes in the form of the embodiments described herein may be made without departing from the spirit of the disclosures. The accompanying claims and their equivalents are intended to cover such forms or modifications as would fall within the scope and spirit of the disclosures.

What is claimed is:

1. A printer comprising:

a conveying unit configured to conveying a medium;

an image forming unit provided in a conveyance path of the medium, the image forming unit being configured to form an image with a temperature-sensitive ink, whose color is changed depending on a temperature, on the medium;

a cutter provided in the conveyance path downstream of a medium conveyance direction of the image forming unit, the cutter being configured to cut the medium conveyed in the conveyance path; and a coloring conversion unit provided in the conveyance path downstream of a medium conveyance direction of the cutter, the coloring conversion unit being configured to change a coloring state of the image of the temperature-sensitive ink by heating or cooling the image of the temperature-sensitive ink formed on the cut medium.

2. The printer of claim 1, further comprising:

a discharge outlet provided in the conveyance path downstream of a medium conveyance direction of the coloring conversion unit, the discharge outlet being configured to discharge the medium having an image of the temperature-sensitive ink formed thereon, whose coloring state is changed by the coloring conversion unit.

3. The printer of claim 2, further comprising a dew condensation removing member provided in the vicinity of the discharge outlet, the dew condensation removing member being configured to remove moisture generated by dew condensation caused by coloring the medium conveyed in the conveyance path.

4. The printer of claim 1, further comprising a blocking unit provided between the cutter and the coloring conversion unit, the blocking unit being configured to block air heated or cooled by the coloring conversion unit from being blown toward the cutter and the image forming unit.

5. The printer of claim 4, wherein the blocking unit comprises a conveying roller configured to convey the medium cut by the cutter in the medium conveyance direction of the cutter.

6. The printer of claim 4, wherein the blocking unit comprises:

a blower configured to blow the air heated or cooled by the coloring conversion unit; and a guide configured to guide the air blown by the blower from being blown toward the cutter and the image forming unit.

7. The printer of claim 6, wherein the guide is formed with at least one of metal material and resin material.

8. The printer of claim 6, wherein the guide comprises:

a front wall portion disposed in a downstream side of the medium conveyance direction of the coloring conversion unit;

a rear wall portion disposed opposite the front wall portion; and a ceiling surface portion disposed in parallel to the conveyance path, the ceiling surface portion connecting the front wall portion and the rear wall portion above the conveyance path.

9. The printer of claim 1, wherein the coloring conversion unit lowers a temperature of the image of the temperature-sensitive ink formed on the medium by spouting gas.

10. The printer of claim 1, wherein the coloring conversion unit lowers a temperature of the image of the temperature-sensitive ink formed on the medium using a Peltier element.

11. The printer of claim 1, wherein the coloring conversion unit comprises:

a gas cylinder configured to provide a liquefied gas; and a spouting portion coupled to the gas cylinder, the spouting portion comprising a nozzle hole configured to spout the gas toward the medium.

12. The printer of claim 11, wherein the coloring conversion unit further comprises a bracket configured to support the spouting portion in such a manner that the spouting portion is rotatable about a rotation axis extending in the width direction of the medium and is capable of changing a spouting direction of the gas.

13. The printer of claim 11, wherein the coloring conversion unit further comprises:

a cooling fin including a plurality of plate-shaped portions protruding from the spouting portion.

* * * * *